United States Patent [19]

Whatley, Jr.

[11] 4,116,177

[45] Sep. 26, 1978

[54] PRE-VOLATILIZING ELECTRONICALLY CONTROLLED CARBURETOR

[76] Inventor: Norman Whatley, Jr., 3505 E. Lake Way, Littleton, Colo. 80121

[21] Appl. No.: 761,460

[22] Filed: Jan. 21, 1977

[51] Int. Cl.[2] ..... F02B 31/00; F02M 7/00

[52] U.S. Cl. ..... 123/119 R; 123/139 BA; 123/139 BG; 123/139 AW; 123/139 E; 123/131; 123/34 R

[58] Field of Search ..... 123/139 BA, 139 BG, 123/139 T, 139 E, 139 AW, 32 AE, 131, 133, 135, 28, 34 R, 34 A, 119 R, 127

[56] References Cited

U.S. PATENT DOCUMENTS

| | | | |
|---|---|---|---|
| 1,196,552 | 8/1916 | La Porte | 123/119 R |
| 1,376,201 | 4/1921 | Harris | 123/119 R |
| 2,075,877 | 4/1937 | Walker | 123/32 AE |
| 2,687,123 | 8/1954 | Parsons | 123/139 E |
| 2,856,910 | 10/1958 | Goodridge | 123/32 AE |
| 3,006,329 | 10/1961 | Armstrong et al. | 123/139 BG |
| 3,014,473 | 12/1961 | Shallenberg | 123/139 BG |
| 3,506,859 | 5/1970 | Pantano | 123/34 X |
| 3,911,872 | 10/1975 | Hughes | 123/139 E |

*Primary Examiner*—Wendell E. Burns

*Attorney, Agent, or Firm*—Horace B. Van Valkenburgh; Frank C. Lowe

[57] ABSTRACT

A carbureting device for internal combustion engines providing pre-volatilized light gasoline vapor and a means for conserving unvaporized gasoline. An electronic pulsing circuit powers and controls the operation of an array of electric fuel pumps connected to the nozzles of a communicating array of volatilization chambers. Operating electric fuel pumps, through the connected nozzles, deliver spurts of liquefied gasoline spray mist onto ribbed inner surfaces of volatilization chambers. Liquefied mist phase of gasoline and evaporation ribs of volatilization chambers accelerate evaporation of liquefied gasoline spray mist, producing light gasoline vapor in volatilization chambers. Unvaporized gasoline drains from volatilization chambers to a fuel storage chamber and is recycled for change of phase to light gasoline vapor. Pressure equalization valves channel a vacuum induced primary intake air stream through the hollow cone of the inner air fuel mixing chamber, connected to apertures of the volatilization chambers. The passing intake air stream, enroute to the engine combustion chambers, induces light gasoline vapor from within the volatilization chambers through the chamber apertures. The induced fuel, prevolatilized to light gasoline vapor, mixes more efficiently with the intake air flow during the available time span enroute to the combustion chambers, providing a more homogenous air/fuel mixture to the chambers.

Providing prevolatilized light gasoline vapor to mix more homogenously with the inducting intake air stream and conserving the unvaporized gasoline should, by this invention, greatly minimize unvaporized gasoline being introduced to the intake air stream, substantially providing only light gasoline vapor to the engine for more thorough combustion and greatly improving the gasoline efficiency and gasoline mileage of the engine from the effect of significantly reducing unburned hydrocarbon pollution, a waste attributed to unvaporized gasoline.

24 Claims, 11 Drawing Figures

PRE-VOLATILIZING ELECTRONICALLY CONTROLLED CARBURETOR

BACKGROUND

This invention was developed to improve the operations of the conventional automotive downdraft carburetor, in order to provide more efficient operating characteristics and to produce a more effective air/fuel processing system which should improve greatly, the gasoline efficiency of the automotive internal combustion engine. The invention was developed under the premise that any improvements made to provide more efficient carburetion would likewise improve the gasoline efficiency of the engine. As a secondary objective, the reduction of unburned hydrocarbon pollutants was considered and should be an appreciable by-product of an efficient air/fuel processing system which increases fuel efficiency of the gasoline internal combustion engine.

The process of carbureting the air and gasoline fuel in the conventional downdraft carburetors, operating today's automotive internal combustion engines, is primarily responsive to the movements of the throttle valve, normally situated in the throat of the carburetor. The engine acceleration and speed relate to carburetion rate, since the rate of carburetion is effected by the throttle valve rotary movements providing variable control of the rate of intake air flow through the carburetor, which simultaneously induces the fuel into the intake air stream and routed to the engine's combustion chambers. The air flow is generated or drawn into the carburetor by means of the engine cylinders successive intake or suction strokes. Hence, the carburetion process in the conventional carburetor lies in the movements of or is dependent upon the movements of the throttle valve, changing the rate of the intake air flow and dependent upon the fuel induction vacuum.

For instance, at engine idle speed, the throttle valve is normally closed permitting only a very limited quantity of air to be sucked past the throttle valve, thereby setting up a high vacuum in the intake manifold and induction of the gasoline from the idle jet to sustain the engine's operation at idle speed. For low speed acceleration, the throttle valve is rotatably open slightly, exposing the low speed fuel jet. The air being sucked past the low speed jet creates a partial vacuum, inducing gasoline fuel from the low speed jet into the flow of the increased air stream. For full engine acceleration, the throttle valve is rotatably opened fully for induction of the gasoline fuel from the high speed jet. When the throttle valve is first opened fully, the intake manifold vacuum pressure momentarily drops and a higher gasoline input is required. The difference in the pressure between the upper part of the carburetor air horn and the low speed jet is not great enough to continue the induction of gasoline from the low speed jet or induce fuel from the high speed jet in the upper part of the air horn. Consequently, there is a momentary loss of induced fuel. However, the accelerator movements that opened the throttle valve fully and caused the momentary loss of induced fuel, simultaneously triggers the mechanically operated accelerator jet that manually injects a flow of unvaporized liquid gasoline into the carburetor's throat, that vaporizes into the air stream and sustains the engine's high speed operation during the momentary loss of induced fuel. This allows the intake manifold vacuum to stabilize and the air flow to create a vacuum at the high speed jet, inducing gasoline fuel for continuous operation of the engine at the high speed mode.

Each of the jets are serviced by the carburetor's float chamber that stores the liquid gasoline. As the induced liquid gasoline leaves the jets described and enters the air stream, the fuel is theoretically atomized or broken-up into a mist. According to the Encyclopedia Americana, less than half of the gasoline entering the air stream makes the change of phase from the liquid phase to the vaporized or gaseous phase. The unvaporized gasoline in the air stream consists of heavy particles ranging from a fine mist to particles of appreciable size. Of further consequence, during the short time span available during the carburetion process, a thoroughly homogenous mixture of air and gasoline has not been achieved so that all fuel particles can react with the oxygen in the cylinder. Thus, the intake manifold that distributes the air to the various engine cylinders will not necessarily distribute the unvaporized gasoline equally, because the inertia of unvaporized heavy fuel particles is considerably greater than that of air molecules. Consequently, the engine's combustion of the air/fuel mixture is incomplete, with most of the unvaporized gasoline passing through the engine unburned or partially burned and wasted. According to recent reports released by the Environmental Protection Agency (EPA), these unburned or partially burned and wasted gasoline particles are unburned hydrocarbon properties of the spent gasoline and one of the primary sources of automotive pollution.

OBJECTS OF THE INVENTION

This invention introduces a new concept in automotive downdraft carburetors. An object of this invention is thus to provide a new and improved downdraft carburetor that should effect more efficient carburetion and engine gasoline efficiency by featuring the supply of liquid gasoline fuel to centrally located gasoline vapor generating chambers, by electrical fuel pumps controlled by an electronic computer driving circuit, deriving its electrical driving pulses from the engine ignition circuit.

Another object of this invention is to provide a new and improved downdraft carburetor which produces more efficient carburetion and engine gasoline efficiency by pumping liquid gasoline to atomizing nozzles and exposing the atomized liquid gasoline spray to irregular surfaces of volatilization chambers, whereby the chamber surfaces influence and accelerate the change of phase to gasoline vapor.

A further object of this invention is to provide a new and improved downdraft carburetor that effects more efficient carburetion and engine gasoline efficiency by providing only that instant volume of gasoline vapor for induction through the volatilization chamber's ventilator openings and from the volatilization chamber's central location sustain engine operation for all idle, low and high modes of speed.

Still a further object of this invention is to provide such a new and improved downdraft carburetor which continuously shunts unvaporized heavy liquid gasoline spray particles from the volatilization chambers to provided fuel storage chamber servicing electric fuel pumps and integrating the unvaporized heavy liquid gasoline spray particles with the supply of liquid gasoline stored in the fuel chamber and pumped to the atomizers in the volatilization chambers for change of phase.

Another object of this invention is to provide a new and improved downdraft carburetor that effects more efficient carburetion and engine gasoline efficiency by providing the feature of constant induction vacuum by means of including a stationary vacuum retention chamber constituting a vacuum circuit, whereby included pressure equalization valves uniquely distribute high and low intensity vacuum pressure providing stable vacuum which handles continuously the efficient operation of the engine in the idle, low and high speed modes, as well as the random transitional changes between these modes.

Still another object of this invention is to provide a new and improved downdraft carburetor that effects more efficient carburetion and improves engine gasoline efficiency by compensating for the vacuum drop and induction loss inherent in sudden higher speed operations, by providing a stable source of induction vacuum.

A further object of this invention is to provide a new and improved downdraft carburetor that effects more efficient carburetion and engine gasoline efficiency by providing a mechanical adjustable means to distribute the engine manifold vacuum pressure into primary and secondary inductive regions, whereby the high vacuum pressure and the low rate of flow of the intake air stream in the idle speed mode is subdivided into both a primary and an alterable, secondary path of flow, thereby providing the means to adjust the primary rate of intake air flow for production of adequate fuel induction vacuum and optimum engine operation under various atmospheric pressure conditions.

Another object of this invention is to provide such a new and improved downdraft carburetor, whereby pre-volatilized light gasoline vapor more readily and effectively mixes homogenously with intake air flow during induction time span enroute to combustion chambers and effects more thorough combustion of the air/fuel mixture.

Still a further object of this invention is to provide a new and improved downdraft carburetor that, in providing prevolatilized light gasoline vapor, should effect more efficient carburetion and an overall improvement in the gasoline efficiency to improve the gasoline mileage of the automotive internal combustion engine and, in conserving the unvaporized liquid gasoline particles and effecting more thorough combustion of the air/fuel mixture, should reduce the unburned hydrocarbon pollutants expelled from the operating engine.

SUMMARY OF THE INVENTION

This invention comprises a carburetor having one or more intake air chambers, the flow of air through which is controlled by slidable intake valves, which may carry or actuate cams to control a series of switches, in turn controlling electric fuel pumps. The air permitted by the air intake control valves flows into a vacuum retention chamber having a bypass which may be controlled by adjusted pressure equalization valves of the butterfly type. The vacuum retention chamber assists in drawing air into the carburetor during engine operation. The air then passes to a mixing chamber into which gasoline vapor is induced from one or more of a series of volatilization chambers which may flank, on each side, the mixing chamber. A mist type spray nozzle is provided in each volatilization chamber, while a series of ribs extending from the walls of the chamber, as well as on the rear side of a splatter plate, assist in the vaporization of fuel. The splatter plate is in spaced relation to the opening of each volatilization chamber and essentially prevents direct flow of atomized liquid fuel from the volatilization chamber into the mixing chamber. Any fuel which is not vaporized collects as a liquid and drains through appropriate holes in the volatilization chambers, for return to a fuel storage chamber. Each fuel pump, which is electrically driven, feeds fuel to the atomizer of one specific volatilization chamber and operates in accordance with the impulses of the current which is supplied from the ignition circuit of the engine. A combination of two or more fuel pumps are operated during the idle mode, the low speed mode and the high speed mode of the operation of the engine, with different pumps being included in some, but not all, of the modes. An electronic circuit responsive to the closing of one or more switches controls the pumps selected for a particular mode. Conveniently, the edges of the slide type air intake valves are formed as cams to open and/or close the control switches, while these valves may also move separate cams.

BRIEF DESCRIPTION OF THE DRAWINGS

The above and other objects, features and advantages of the present invention will become apparent from the following description with reference to the accompanying drawings, wherein.

DESCRIPTION OF THE PREFERRED EMBODIMENT

Figure 2:
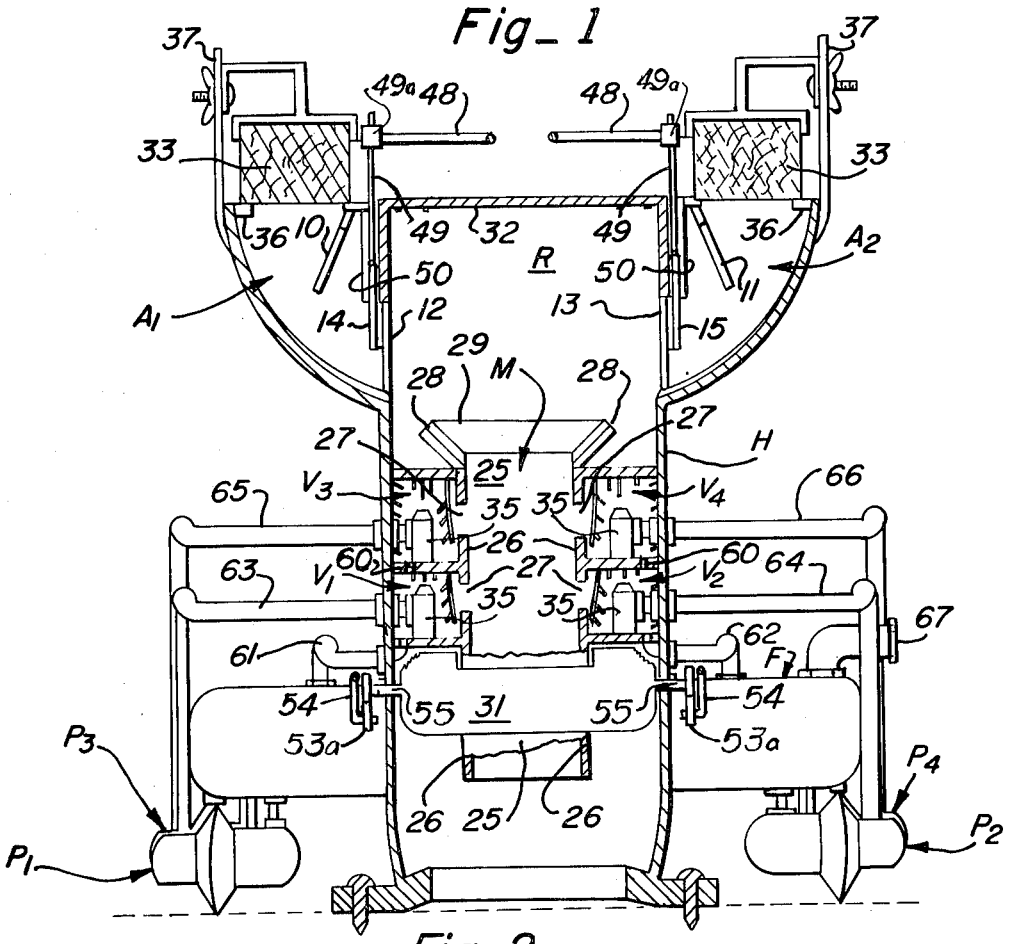
FIG. 2 is a vertical section of the carburetor, taken along line 2—2 of FIG. 1.

Referring now to the drawings, in which like numerals denote similar parts throughout the several views, FIG. 2 shows certain major components of the new device, including laterally spaced, outer air inlet chambers $A_1$ and $A_2$, a vacuum retention chamber R, conveniently disposed between the air inlet chambers, and an inner air/fuel mixing chamber M, disposed centrally below chamber R and coupling two tiers of volatilization chambers $V_1$ through $V_4$. These components are conveniently located within a housing H, alongside which, as at a lower position, is a fuel chamber F from which, as in FIG. 2, fuel is pumped to the respective volatilization chambers by electrical pumps $P_1$ through $P_4$, inclusive. Within the air chambers $A_1$ and $A_2$ are butterfly choke valves 10 and 11, respectively, which pivot toward a closed position to reduce the flow of air through the respective openings 12 and 13 from the air chamber $A_1$ or $A_2$ to the vacuum chamber R. Intake valves 14 and 15 are conveniently gate type valves, slidable upwardly and downwardly along the respective openings 12 and 13, to control the flow of air during normal operation. As in FIGS. 4, 5 and 8–10, a pair of switches $S_1$ and $S_4$ are associated with valve 15, being closed through a pin 17 which engages, in open position, a notch 18 in a lateral edge of the valve. Similarly, switch $S_4$ remains open when pin 17 engages a notch 20 in the opposite edge of the valve. Notches 18 and 20 may be formed in a separate cam plate or plates, attached to the valve or to the edges thereof.

Valve 14 similarly controls the opening and closing of switches $S_2$ and $S_3$, through a notch 21 in a lateral edge of the valve for the former and a notch 23 for the latter. It will be noted that, although pump $P_1$ supplies volatilization chamber $V_1$, pump $P_2$ supplies volatilization chamber $V_2$, pump $P_3$ supplies volatilization chamber $V_3$ and pump $P_4$ supplies volatilization chamber $V_4$, the switches $S_1$ through $S_4$ are not similarly correlated with the pumps in accordance with the electronic control diagram of FIG. 11, to be described later. Generally, pumps $P_1$ and $P_2$ are operated during the idle mode of FIG. 8, pumps $P_3$ and $P_4$ are operated during the low speed mode of FIG. 9, and pumps $P_1$, $P_2$, $P_3$ and $P_4$ are operated during the high speed mode of FIG. 10. The arrangement can, of course, be varied in accordance with the capacity of the respective pumps and volatilization chambers. Thus, although chambers $V_3$ and $V_4$ are shown as being larger in size than chambers $V_1$ and $V_2$, the capacities of the chambers and pumps may otherwise differ. Mixing chamber M may be square in the horizontal plane, as in FIGS. 1 and 2, including end walls 25 and side walls 26 provided with apertures 27 leading from the respective volatilization chambers, which apertures may vary in size when the chambers so vary. At the top, converging lips 28 and 29 lead air into the mixing chamber M. As will be evident, the volatilization chambers occupy the area at each side of the mixing chamber, but a passage 30 exists between each end wall 25 and the housing H, beneath lips 29. Adjacent the lower end of each end of mixing chamber M and disposed in each corresponding passage 30 is a pivoted pressure equalization valve 31 which provides an additional suction area which communicates with the vacuum retention chamber R, the upper end of which is closed by a dome 32.

The central vacuum retention chamber R is a principal carbureting component of the new device, whereby fuel will be drawn from the volatilization chambers to effect a more efficient interacting of the vacuum pressure, induced intake air stream and light gasoline vapor in concert with the operating engine. The vacuum retention chambers with the intake control valves 14 and 15 more closely represent a closed vacuum circuit whereby the air intake valves 14 and 15 provide a controlled rate of flow of leakage air from the atmosphere into the vacuum circuit produced by suction and induction strokes of the operating engine. Hence, the air intake control valves may be considered, in effect, an extension of the vacuum retention chamber, whereby opening and closing the air intake control valves to increase or decrease the rate of leakage intake air flow, respectively increase or decrease the degree of vacuum in the vacuum retention chamber. In the idle speed mode of the engine, the valves are adjusted to slight opening for optimum operation under any atmospheric condition, whereby high vacuum builds up in the vacuum retention chamber and draws in leakage intake air at a sufficient rate through the slight openings to sustain engine operation in the idle speed mode. The pressure equalization valves 31 are adjusted coincidental to air intake valves in the idle speed mode, as later described. In the low and high speed modes, the increased medium and high rates of leakage intake air flow is drawn through the appropriately greater openings of the air intake control valves 14 and 15, whereby the increased rates of leakage intake air flow displaces a relative portion of the manifold vacuum pressure build-up in the vacuum retention chambers. Because the vacuum retention chamber is a stationary vacuum circuit, it, in conjunction with the pressure equalization valves uniquely distributing the high and low intensity vacuum pressure with the changing speeds, tends to stabilize the induction vacuum pressure and sustains efficient engine operation in the event of sudden acceleration of the engine.

The outer air control chambers $A_1$ and $A_2$ channel the flow of air from the atmosphere through a filter 33 and around the choke valves 10 and 11 into the chamber R. When the choke valves are closed for cold starting of the engine, an even higher degree of manifold vacuum build-up in space R is obtained, and the rate of flow of the filtered intake air stream is greatly reduced for all idle, low and high speed modes, by means of the obstructing choke valves 10 and 11, thereby providing less air for a richer air/fuel mixture during cold operation of the engine. As the operating engine heats up, the volatility of the gasoline is enhanced by the rising temperature and improves the evaporation rate of the gasoline. Also, the formerly closed choke valves 10 and 11 recede to a fully open position, due to the rising temperature of the engine and permit the rate of flow of the leakage intake air stream to increase relative to the declining obstruction posed by the receding choke valves.

The purpose of the volatilization chambers $V_1$ through $V_4$ is to provide pre-volatilization by means of influencing both the high and low temperature components of the liquid gasoline to change in phase to gasoline vapor before introduction to the intake air stream and store, for an instant, the emanating light gasoline vapor for subsequent induction by the intake air stream. The chamber surfaces include evaporation ribs as a vehicle to stimulate the acceleration of the change of phase vaporization process. When the liquid gasoline is sprayed onto the surfaces of the volatilization chambers, by means of liquid fuel atomizers 35, the latent heat of the liquefied gasoline spray mist and the exposed surfaces of the ventilated volatilization chambers accelerate the evaporation rate of the liquefied gasoline spray mist. A high operating temperature of the engine stimulates evaporation of the high temperature components, as well as the low temperature components of the liquefied gasoline spray mist to more readily make the change of phase to light gasoline vapor. At idle, low or high speeds, the leakage intake air stream keeps the air pressure in the volatilization chambers below atmospheric.

When the engine is turned over for starting, all of the air in the volatilization chambers is sucked out by the passing intake air stream, bringing the chamber pressures down below atmospheric. During subsequent operation of the engine, the light gasoline vapor is drawn from the chambers into the passing intake air stream, keeping the chamber pressures below atmospheric. Because the chambers are below atmospheric, suction is exerted against the evaporating liquefied gasoline spray mist. Hence, the liquefied gasoline spray mist can more readily evaporate with no impedance and collect in the volatilization chambers for induction by the intake air stream. The unvaporized, heavy liquid gasoline particles drain from the chamber surfaces back to the fuel chamber F through ports 60 and are recycled for change in phase to light gasoline vapor.

The purpose of the inner mixing chamber M is to collect and concentrate the major or primary portion of the intake air flow and speed the primary intake air flow through the hollow cone of the inner air/fuel mixing chamber past the volatilization chamber apertures 27, thereby creating vacuum at the apertures to reduce the chamber pressure and draw the collected light gasoline vapor out of the chambers, thereby providing a primary air/fuel mixture routed to the inducing combustion chamber. The prevolatilized light gasoline vapor more readily mixes with the inducing intake air stream and more effectively makes use of the available time span enroute to the combustion, thereby providing a more homogenous air/fuel mixture to the inducing combustion chamber.

Figure 11:
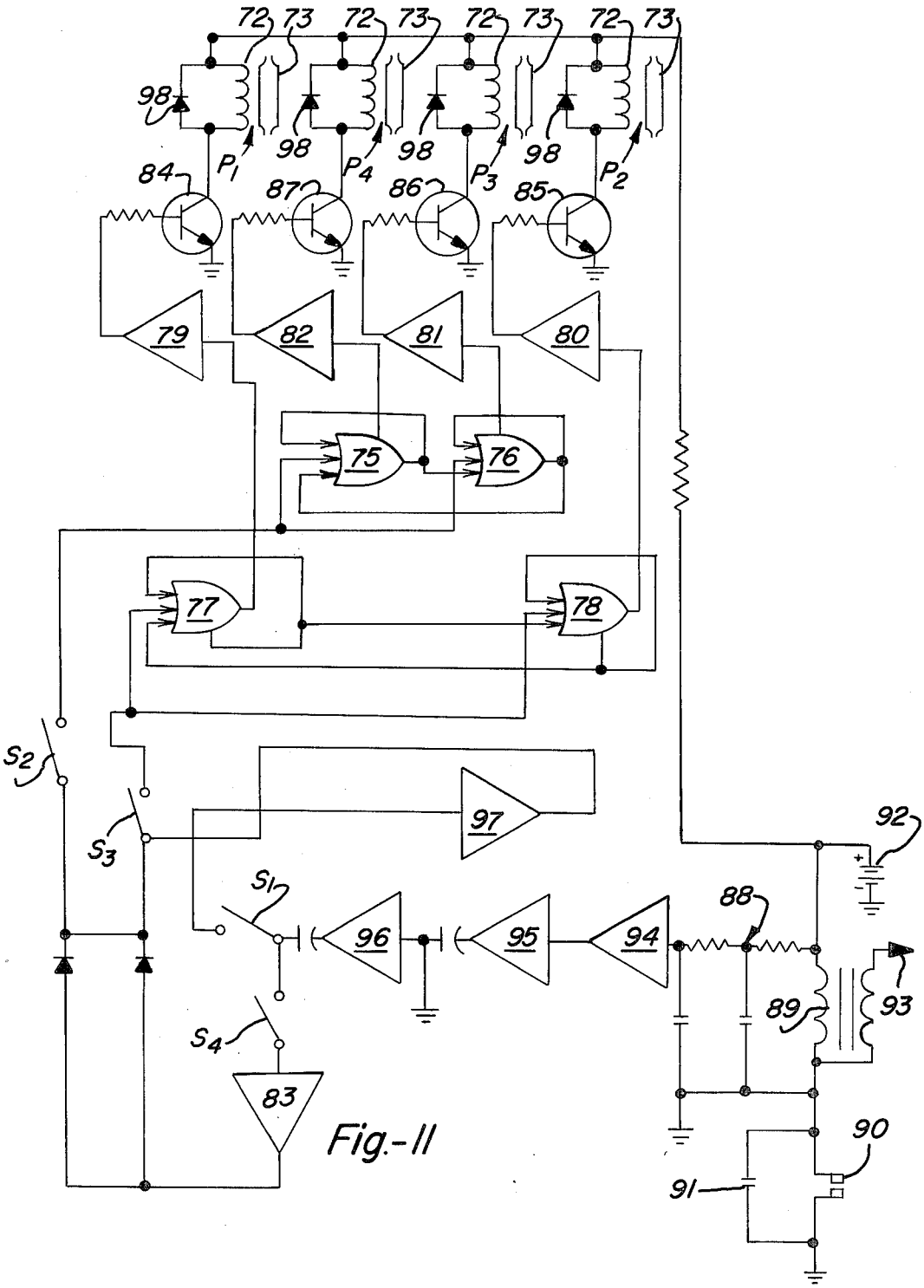
FIG. 11 is a diagram of the electronic circuit controlled by the switches of FIGS. 8–10 and in turn controlling the fuel pumps.

The outer air inlet chambers $A_1$ and $A_2$ may each comprise a semicircular sloping chamber disposed along the upper portion of two of the four sides of the center vacuum retention chamber R. The air filters 33 are mounted on retaining ledges 36 and are held in position by disassemblable retaining brackets 37. The twin air filters are of conventional construction and shaped the same as the mouths of the twin semicircular sloping air intake passages $A_1$ and $A_2$, i.e. in a half-moon configuration. The microswitches $S_1$ through $S_4$, included as an integral part of the electronic control and drive circuit of FIG. 11, are received vertically at the upper inner edge of the respective air chambers, thus being mounted parallel to the path of movement of the corresponding cams of the air intake control valve 14 or 15.

The purpose of the pressure equalization valves 31 is two-fold. They distribute uniquely the high and low intensity vacuum pressure from the manifold to chamber R and provide an adjustable means to direct the major or primary portion of the vacuum pressure and related intake air flow through the hollow cone of the inner air/fuel mixing chamber M, to insure that the fixed volatilization chambers $V_1$ through $V_4$ stay below atmospheric and induce the light gasoline vapor into the pasing leakage intake air stream, under any atmospheric pressure conditions. This is done by adjusting the pressure equalization valves to an open position while the engine is operating in the idle speed mode, and attaining optimum idle speed operation. In the idle speed mode, vacuum pressure of high intensity is built up in the engine manifold, whereby the open pressure equalization valves divert the major or primary portion of the highly intense vacuum pressure through the primary zone, comprising the hollow cone of the inner air/fuel mixer M and the residual portion through the secondary zone, i.e. the openings of the pressure equalization valves, whereby the high vacuum pressure is built up in the retention chamber R. In addition to permitting adjustments in the idle speed mode to attain optimum engine operation, the pressure equalization valves are connected to close synchronously with the opening of the air intake valves 14 and 15 in operating the engine in the low and high speed modes, whereby the pressure equalization valves divert more and more of the declining vacuum pressure from the secondary zone to the primary zone as the engine acceleration increases fron the low speed to the high speed. When the air intake control valves 14 and 15 are opened, fully operating the engine in the peak high speed mode, the pressure equalization valves are fully closed in the same synchronous movement, concentrating the entire volume of low intensity vacuum pressure and related leakage intake air flow through the primary zone. Diverting most or all of the available vacuum pressure, through the primary zone in changing from low to high speed, tends to stabilize the induction vacuum and provide for continuous and efficient operation of the engine. Any residual leakage intake air flow through the secondary zone intercepts the primary air/fuel mixture at the base of the hollow cone of the mixing chamber M and further mixes homogenously with the mixture enroute to the combustion chambers. Adjustments are made by turning the pressure equalization valves, as by a mechanism described below, that further closes the pressure equalization valves synchronously with the opening of the intake air valves.

Figure 1:
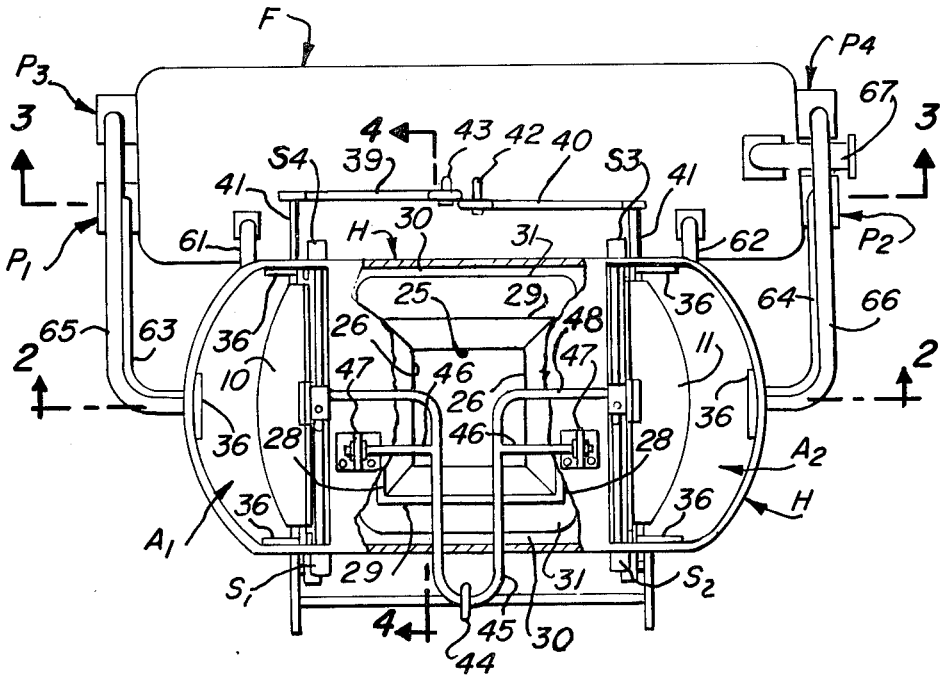
FIG. 1 is a top plan view of a carburetor of this invention, partially broken away to show parts in the interior thereof.
Figure 7:
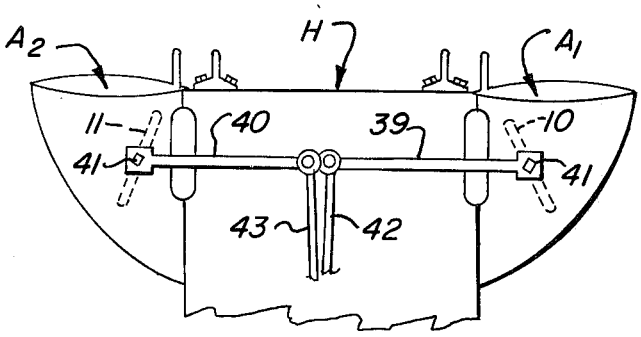
FIG. 7 is a fragmentary front elevation of the carburetor, showing the upper portion thereof.
Figure 8:
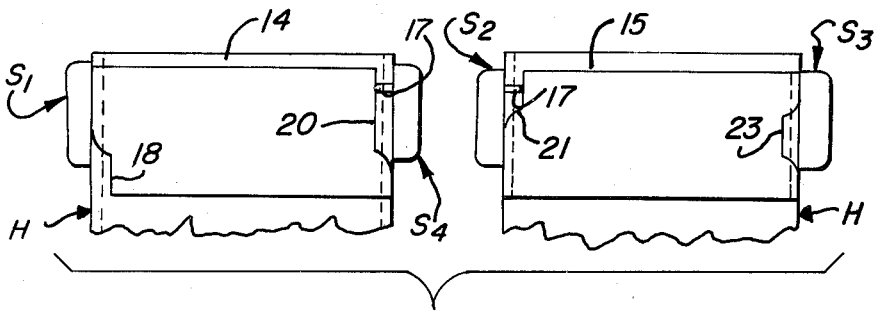
FIG. 8 is a diagrammatic representation of a pair of intake control valves whose edges act as cams to control four switches which, in turn, through an electronic circuit, control the fuel pumps which supply fuel to the volatilization chambers and relating to the idling mode of operation of the engine.
Figure 9:
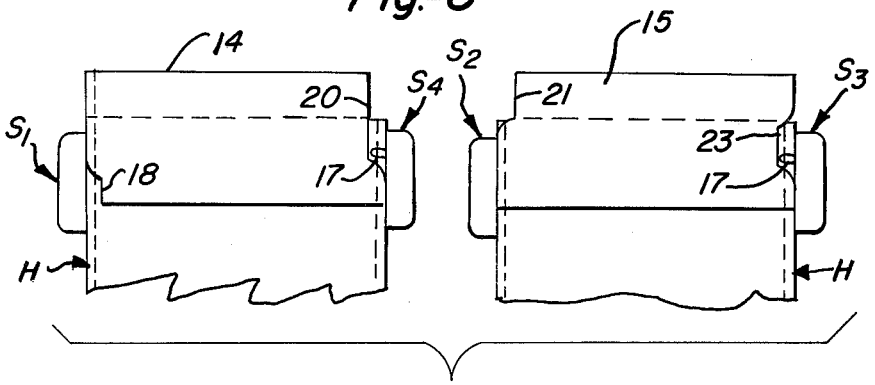
FIG. 9 is a similar diagrammatic representation, relating to the low speed mode of operation of the engine.
Figure 10:
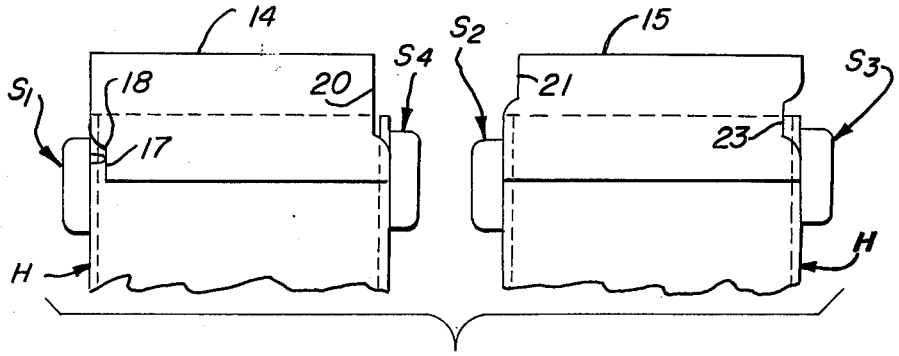
FIG. 10 is a similar diagrammatic representation, relating to the high speed mode of operation of the engine.

The choke valves 10 and 11 operate substantially in cycles, with respect to the operating temperature of the engine and are operated by a conventional thermal mechanical means for movement to a fully open position when the engine is hot or to a fully closed position when the engine is cold, with the choke valves becoming stationary at various positions between these two operating extremes. The choke valves also provide means for mechanically altering the rate of intake air flow induced into the air intake chambers. Illustrated in FIGS. 1 and 7 are certain movable parts of the choke valve operating mechanism, including a pair of horizontal pivot rods 39 and 40 which are connected to pivot stems 41 of the respective choke valves 10 and 11. Rods 39 and 40 are, in turn, pivoted by the respective operating rods 42, 43 to which the above thermo mechanism means is, of course, connected in a conventional manner. When vertical lever rods 42 and 43 are moved in a downward direction, the two horizontal pivot rods 39 and 40 pivot downward and rotate the choke valves toward a closed position, i.e. toward the mouth of the air intake chambers, thereby reducing the rate of flow of the intake air stream. When the vertical lever rods 42 and 43 are moved in an upward direction, the two normally horizontal pivot rods 39 and 40 pivot upward and rotate the choke valves toward an open position, i.e. toward the air intake control valves 14 and 15, thereby increasing the possible rate of flow of the intake air stream.

Figure 5:
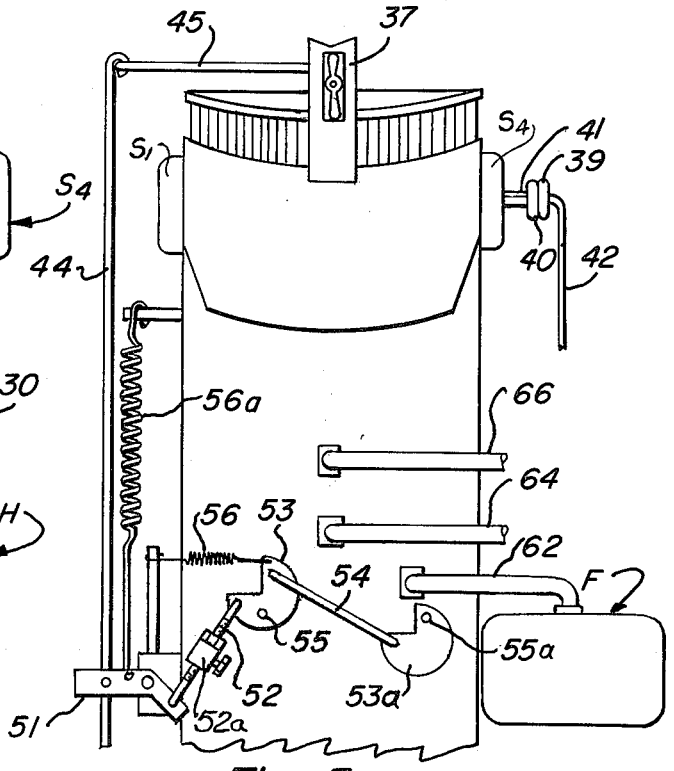
FIG. 5 is a fragmentary side elevation of the carburetor.

The air intake control valves 14 and 15 are operated by an accelerator rod 44 of FIGS. 1 and 5 controlled by a conventional mechanism connected to the accelerator pedal of the automobile and moving a forked link 45, having intermediate arms 46, each pivoted in a standard 47, with a connection through an end arm 48 to the respective stem 49 of the sliding air control valves 14 and 15. The latter are slidable in vertical guide channels 50 of FIG. 2 and adjustable unwardly or downwardly, as for idle speed position, through the corresponding stem 49, through a stem connector 49a. As indicated previously, the air intake control valves 14 and 15 serve the two-fold purpose of providing a controlled rate of flow of intake air into the carburetor and simultaneously operating the miscroswitches $S_1$ through $S_4$ for the electronic control and drive circuit of FIG. 11.

The pressure equalization valve 31, as in FIG. 5, may be pivoted through upward or downward movement of the accelerator rod 44, through a lever 51 pivoted on a bracket attached to the side of housing H, as shown, and connected by link 52, adjustable in length, to a three-quarter disc 53, in turn connected by a rod 54 to a second three-quarter disc 53a. Discs 53 and 53a are mounted on a pivot rod 55, or 55a for the respective valve 31, while a spring 56 resists clockwise movement of disc 53 and a spring 56a resists counterclockwise movement of lever 51 to assist in bringing valves 31 back toward idle position when the accelerator rod 44 is released. As will be evident from FIG. 4, the two valves 31 will pivot in opposite directions to move toward closed or open position together. FIG. 5 shows the position of the mechanical components 51 through 56a after the valves have been adjusted to a vertical open position for the idle speed mode, opposed to the diagonally closed position of the valves, FIG. 4. Adjustment for idle position is accomplished through adjustable link 52 by sliding the upper portion of the two pieces thereof out of the connector 52a, exerting force upwards and turning three-quarter disc 53 clockwise, thereby exerting force downwards on diagonal rod 54 and turning three-quarter disc 53a counterclockwise, thus rotating to pivots 55 of the pressure equalization valves 31, as in FIGS. 1 and 4, toward the closed position. The reverse of the operation may be used to adjut valves 31 toward open position. Rod 54 may also be made adjustable to permit accuracy in positioning valves 31 for placement at and movement in synchronism to the same relative positions. As will be evident, as accelerator rod 44 moves downwardly to open air intake valves 14 and 15 for engine operation in the low and high speed modes, lever 51 will pivot synchronously in a counterclockwise direction, thereby pushing adjustable rod 52 upwardly and rotating disc 53, along with valve pin 55, in a clockwise direction to move the corresponding valve 31 toward a closed position. At the same time, disc 53a will be turned in a counterclockwise direction to pivot stem 55a in the same direction and move the corresponding valve 31 toward a closed position. A similar mechanism, situated at the opposite side of housing H and connected similarly to the accelerator rod 44 and the pivot rods 55 and 55a, at the opposite side of valves 31, provides for a more orderly operation of the valves.

The microswitches $S_1$ through $S_4$, as in FIG. 1, are adjustably mounted at the upper inner edge of the outer air chambers $A_1$ and $A_2$ and positioned vertically to extend parallel to the outer vertical edges of cam plates 19 and 22 attached to the air intake control valves 14 and 15. Thus, the slidable operations of the air intake control valves 14 and 15 depress or release the compression pins 17 of the microswitches, thereby making and breaking sub-circuit connections in the electronic control and drive circuit of FIG. 11. The microswitches are structured to preclude electrical arcing in making and breaking circuit connections and thereby capable of operating safely in highly flammable areas. The compression pin 17 of each microswitch is centered and extends through an aperture in the wall of the respective outer air inlet chamber into the path of cam plate 19 or 22. The switch compression pins are depressed and released through the sliding up and down motion of the cams, corresponding to the open and close motions of the air intake control valve 14 or 15, corresponding to the idle, low and high speed modes of the engine. The notches 18, 20, 21 and 23 correspond to the requirements for the various idle, low or high speed operating modes of the engine and are calibrated to depress or release the compression pins of particular sets of the four microswitches, with a switch being open when its pin 17 is extended into a notch and closed when the pin is depressed by the cam. Thus, in the idle mode of FIG. 8, switches $S_1$ and $S_3$ are closed, while switches $S_2$ and $S_4$ are open; in the low speed mode of FIG. 9, switches $S_1$ and $S_2$ are closed, while switches $S_3$ and $S_4$ are open; and in the high speed mode of FIG. 10, switches $S_2$, $S_3$ and $S_4$ are closed, while switch $S_1$ is open. As will be evident, in the idle mode of FIG. 8, the air intake control valves 14 and 15 are in nearly closed position, and the corresponding cam plates 19 and 22 in a similar position; in the low speed mode of FIG. 9, the air control valves 14 and 15 are in a partially open position; and in the high speed mode of FIG. 10, the air control valves are in a substantially fully open position. As indicated previously, it is to be noted that the fuel pumps $P_1$ through $P_4$ are correlated with the vaporization chambers $V_1$ through $V_4$. There is not the same correlation between the switches and the fuel pumps or vaporization chambers.

Figure 6:
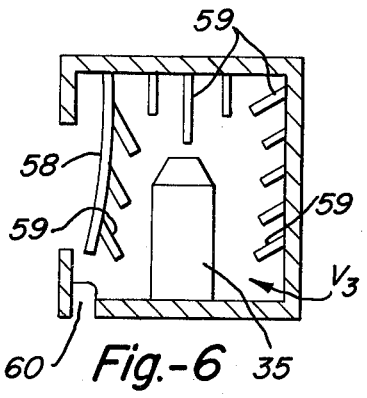
FIG. 6 is an enlarged section of one of four volatilization chambers shown also in FIG. 2.

The tiered volatilization chambers $V_1$ through $V_4$, as in FIGS. 2 and 6, are divided into two tiers of two chambers, each on opposite sides of inner air/fuel mixing chamber M. Each of the volatilization chambers produces a volume of light gasoline vapor, in proportion to their individual size and vapor generating capacity, by reducing pumped spurts of liquid gasoline to a liquefied gasoline spray mist, by means of the liquid fuel atomizers 35 which break up the spurts of liquid gasoline into gasoline spray mist and eject the liquefied gasoline spray mist onto the interior surfaces of the chambers, whereby the interior chamber surfaces influence the evaporation rate of the liquefied gasoline spray mist to produce a change of phase of light gasoline vapor. The volume of light gasoline vapor is induced from within the volatilization chambers into the intake air stream passing through air/fuel mixing chamber M.

Figure 3:
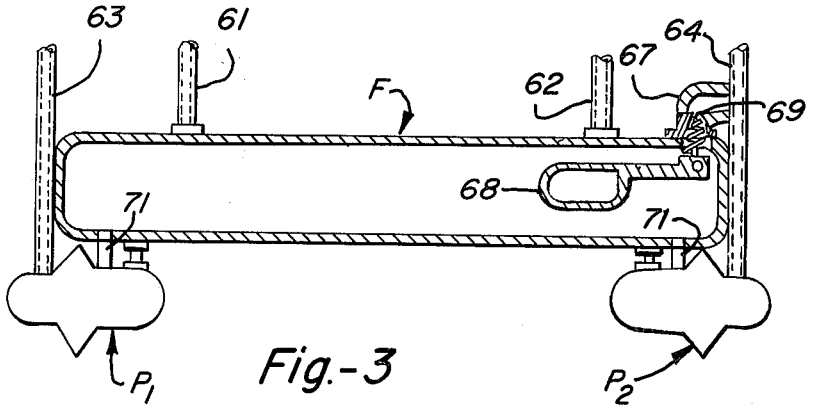
FIG. 3 is a vertical section of a fuel storage chamber, taken along line 3—3 of FIG. 1.
Figure 4:
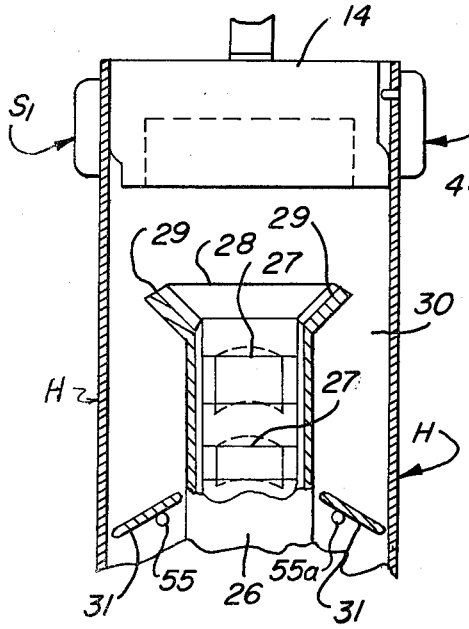
FIG. 4 is a vertical section transverse to FIG. 2 and taken along line 4—4 of FIG. 1.

Each of the tiered volatilization chambers, with chamber $V_3$ of FIG. 6 being typical, includes a splatter plate 58, as in FIG. 6, spaced across the discharge aperture 27 of the chamber, extending above the top and below the bottom of opening 27 and liquid fuel atomizers composed of nozzles with pinpoint openings for breaking up the pumped spurts of liquid gasoline. Evaporation ribs 59 on the walls and ceiling of the chambers and also on the rear side of the splatter plate provide a greater surface for impingement of the fuel and evaporation of the fuel. Any liquid fuel draining onto the floor of a volatilization chamber drains through ports 60 back to fuel chamber F. Volatilization chambers $V_3$ or $V_4$ drains through a port 60 into the chamber below. The excess unvaporized fuel in chambers $V_1$ and $V_2$ drains from ports 60 through a tube 61 or 62 to the fuel chamber F. The electric fuel pumps $P_1$ through $P_4$, as in FIGS. 1, 2 and 3, are connected to the respective fuel atomizers 35 in chambers $V_1$ to $V_4$, respectively by pipes 63 through 66, respectively. The electric fuel pumps deliver liquid gasoline fuel from the fuel storage chamber F to the respectively connected liquid fuel atomizers in spurts of the liquid fuel, coinciding with the electrical pulses from the automotive ignition system and the electronic control and drive circuit of FIG. 11, which power the electric fuel pumps intermittently, consistent with the transmitted pulses. The pinpoint openings in the nozzles of the liquid fuel atomizers 35 break up the spurts of liquid gasoline into a fine liquefied mist, and the pump pressure, which delivers the liquid gasoline spurts to the nozzles, causes the liquefied gasoline mist to be ejected from the nozzles onto the interior walls and ceiling surfaces of the volatilization chambers, saturating the chamber surfaces with the liquefied gasoline spray mist. The electronic control and drive circuit of FIG. 11 causes the electric fuel pumps to be operated in pairs, sets of pairs and alternately in pairs and the sets of pairs.

The fuel chamber F receives fuel from a conventional fuel pump connected to an intake pipe 67, as in FIGS. 2 and 3, and is provided with a float 68 controlling an inlet valve 69. Fuel flows downwardly to each of the respective fuel pumps through a nipple 71.

The electronic control and drive circuit of FIG. 11 is an electronic circuit of monolithic design, combining the operations of several integral sub-circuits that electronically convert the electrical ignition pulses from the ignition system of the automobile, to constant width, square wave pulses which trigger, step by step, a closed loop binary walking ring counter and sub-circuits to produce alternate pulses that are amplified and transmitted to the coils 72 of the operating four electric fuel pumps $P_1$ through $P_4$, thereby energizing the coil for the respective pump diaphragm 73 and magnetically driving the solenoid of the pump diaphragm to deliver spurts of liquid gasoline from the fuel storage chamber F to the respective liquid fuel atomizers 35. The electronic control and drive circuit is composed of both integrated circuits and discrete electronic components. The electronic control and drive circuit consists of a duty cycle integrator sub-circuit, microswitches $S_1$ through $S_4$, two closed loop binary walking ring counter sub-circuits 75, 76 and 77, 78 signal amplifier and non-inverting buffer IC components 79 through 82, a signal amplifier and inverting buffer IC component 83, discrete power transistor components 84 through 87, which energize and drive the pump diaphragms of electric fuel pumps $P_1$ through $P_4$. The duty cycle integrator sub-circuit is composed of a spike filtering network 88 which is connected electrically to each side of the automotive ignition coil 89, in turn connected to the breaker points 90 and condenser 91, as well as the battery 92, with a separate lead 93 to the automobile ignition devices. Two inverter IC components 94 and 95 square the input ignition pulses transmitted across the spike filter network 88 and produce a positive going square wave pulse with a good rise and fall time. A monostable multivibrator IC component 96 operates at one-third (1/3) on time and provides an output positive going square wave pulse of constant width, which is transmitted to an inverter IC component 97 across the microswitch $S_1$ when closed, as in FIGS. 8 and 9. The inverter IC component 97 inverts the constant width, positive going square wave pulse from the monostable multivibrator IC component 96 to a negative going, constant width square wave pulse and transmits the negative going pulse across the microswitch $S_2$ or $S_3$, when closed along with switch $S_1$, as in FIGS. 8 and 9. When closed with switch $S_1$, switches $S_2$ and $S_3$ each serve the basic function of completing the circuit between the inverter IC component 97 and one of the specific closed loop binary walking ring counter sub-circuits 75, 76 or 77, 78. The negative going constant width pulse transmitted across the closed microswitches $S_2$ or $S_3$ toggles the specific closed loop binary walking ring counter subcircuit, whereby on each of the toggle pulses, the closed loop binary walking ring counter sub-circuits produce at their respective outputs, positive going pulses in a sequential one step at a time, or step by step fashion. Each of the binary step computer counting units of the closed loop binary walking ring counter subcircuits 75, 76 and 77, 78 individually complement one of the four separate circuits leading to the four individual electric fuel pumps $P_1$ through $P_4$, whereby the step by step positive going pulses, at their outputs, operate the electric fuel pumps in a similar alternate step by step fashion in pairs and sets of pairs consistent with the closing of microswitches $S_1$ as through $S_4$ as selected by the particular idle, low or high mode of speed. The positive going output pulses are transmitted from the individual binary step computer counting units 75, 76, 77 or 78 in an alternate fashion to respectively connected non-inverting buffer IC components 79 through 82, whereby the buffer IC's amplify the positive going pulses to a higher current level positive going pulses in an alternate fashion to the respectively connected NPN power transistors 84 through 87. The NPN power transistors 84 through 87 receive the positive going higher current level pulses and amplify the pulses to a much higher current level positive going pulses, thereby transmitting the very high level current pulses to the diaphragm coils 72 in parallel with current direction controlling diodes 98 of the electric fuel pumps $P_1$ through $P_4$, energizing the coils and magnetically driving, in an alternate fashion, the pumping diaphragms 73 for one full pump stroke and delivering, in an alternate fashion, spurts of gasoline from the fuel storage chamber on each energizing current pulse to the cooperating pairs and sets of pairs of the four liquid fuel atomizers received in respectively operating volatilization chambers $V_1$ through $V_4$. It will be noted that, in the idle mode of FIG. 8, switches $S_1$ and $S_3$ are closed, thereby driving walking ring counters 77 and 78 and pair of operating pumps $P_1$ and $P_2$ and volatilization chambers $V_1$ and $V_2$ alternately in a step by step fashion. However, in the low speed mode of FIG. 9, switches $S_1$ and $S_2$ are closed, thereby driving walking ring counters 75 and 76 and operating pair of pumps $P_3$ and $P_4$ and volatilization chambers $V_3$ and $V_4$ alternately in a step by step fashion. In the high speed mode of FIG. 10, switch $S_4$, as well as switches $S_2$ and $S_3$ are closed. In this event, switch $S_4$ closes the circuit between monostable multivibrator component 96 and buffer IC component 83. Buffer IC component 83 inverts and amplifies the constant width positive going output pulses from the monostable multivibrator IC component 96 to higher current, negative going constant width toggle pulses for the simultaneous operation of both closed loop walking ring counter subcircuits in sets, such as pair 75, 77 and pair 76, 78 and alternately set by set. Sub-circuits 75, 77 and 76, 78 operate respectively connected electric fuel pumps $P_1$ through $P_4$ and volatilization chambers $V_1$ through $V_4$ in the same alternate set by set fashion.

The closed loop binary walking ring counters 75, 76 and 77, 78 are sub-circuits of the electronic control and drive circuit of FIG. 11, which provide the count sequence and electrical pulses that operate electric fuel pumps $P_1$ through $P_4$ alternately in pairs and alternately within the sets of two pairs, further providing a slight time delay factor, aiding the instantaneous change of phase process taking place in the related volatilization chambers $V_1$ through $V_4$ between sequence of combusting stroke, which in effect provides power, driving electric fuel pumps, and following the induction stroke providing intake air flow. For example, when one of the volatilization chambers in the pair, such as $V_4$ is being saturated alternately with liquefied gasoline spray mist by electric fuel pump $P_4$ on one of the combustion ignition strokes of the engine, the other volatilization chamber in the pair, such as $V_3$, is evacuated alternately of its volume of stored light gasoline vapor on the following induction stroke of the engine, which induces the intake air stream from the atmosphere into the vacuum retention chamber R and in passing through the hollow cone of the air/fuel mixing chamber M, creates vacuum inducing into the passing air stream, the stored volume of light gasoline vapor from within evaporation chamber $V_3$. On the very next combustion ignition stroke saturating evaporation chamber $V_3$ with liquefied gasoline spray mist, the following induction stroke of the engine evacuates the stored volume of light gasoline vapor from within volatilization chamber $V_4$ into the passing and inducing intake air stream. Hence, the volatilization chambers $V_1$ through $V_4$ switch back and forth alternately in pairs or set of pairs between similar saturation operation by electric fuel pumps $P_1$ through $P_4$ and the following evacuation operation by intake air flow, consistent with engine combusting and inducting strokes. This is the normal and fundamental sequence of events for operation of the engine in all modes of speeds.

The inverter IC components 94, 95 and 97 are one input, not gates as specified by digital logic. Inverters 94 and 95 generate the complement of the ignition pulses transmitted across the spike filter network 88, by squaring up the ignition pulses and producing positive going rectangular pulses with good rise and fall time. Inverter 97 inverts the constant width positive output pulses from the monostable multivibrator IC component 96 to negative going constant width pulses. Buffer IC inverter component 83 functions in the same manner with respect to multivibrator IC component 96, when switch $S_4$, rather than switch $S_1$, is closed.

The monostable multivibrator IC component 96 is used as a time interval pulse generator. It consistently provides output pulses of constant time and duty cycle relative to the frequency of the input ignition trigger pulses from the inverter IC components 94 and 95. It is first triggered into its unstable state and, at a later time, flips back to its stable state by itself, as determined by the values of the resistor and capacitor (R-C time constant) and produces a positive going constant width output pulse. The capacitor at the output provides the positive going constant width output pulses at less than ⅓ of the on time of the monostable.

The ring counter elements 75, 76 and 77, 78 of the closed loop walking ring counter sub-circuits are structured of digital logic circuitry, consisting of shift registers that have their outputs crossed coupled to their inputs, forming complementing shift registers. The shift registers consist of JK flip-flops that are toggled by negative going pulses and provide sequential outputs at each of the ring counter stages that further enables the next stages down the line. The first flip-flop is connected upside down and is preset, while the other stage is precleared. For example, when the negative going constant width pulse from the inverter IC component 97 toggles the first stage of 75, the toggle transition passes the output one stage down the line to 76, enabling 76 while the output pulse is transmitted to the buffer IC component 82. The binary walking ring counters 75, 76 and 77, 78, being of the closed loop design, behave as continuous rotating electronic steppers, with each inverted transition from the monostable clock continuously moving one step to the right.

The buffer IC components 79 through 82 are non-inverting, i.e. do not invert the input signal at the output, while buffer IC component 83 inverts the input signal. The buffer IC components are higher power IC's used whenever a more powerful output signal is needed. The common buffers have one input and invert the signal, thus they are nothing but high powered logic, not gates or inverters. The buffer IC components 79 through 82 are, in effect, two high powered inverters back-to-back that initially invert the input signal and re-invert the signal back to the identical input form. The transistor discrete components 84 through 87 are power transistors of the NPN type and respond to negative digital logic.

In starting the engine, a chain of events takes place simultaneously in the device, as follows:

When the conventional accelerator pedal is depressed, thereby moving the accelerator controlled rod 44 to the low speed operating mode for starting the engine, and the conventional automotive starter rotates the crank shaft of the engine, the conventional automotive fuel pump starts the replenishing flow of liquid gasoline from the conventional automotive gasoline tank to the fuel line connector 67, through the open fuel supply control valve 69, into the fuel storage chamber F until the maximum storage level of the fuel storage chamber is reached, at which time the rising fuel float 68 closes the fuel supply control valve 69. The engine is cold, whereby the choke valves 10 and 11 are positioned in the cold start and closed position, thereby minimizing the intake air flow induced from the atmosphere outside the device, through the twin air filters 33, into the twin intake air chambers $A_1$ and $A_2$, past the twin air intake control valves 14 and 15, into the center vacuum chamber R, from which the pressure equalization valves close partially and distribute the intake air flow heavily into the primary and nominally into the secondary vacuum regions. Similarly, when the engine is operating, the choke valves 10 and 11 are gradually opened from the closed position to the wide open position, in response to the rising temperature of the engine, thereby increasing the rate of intake air flow induced from the atmosphere outside the device. The pressure equalization valves 31 are preadjusted in the idle speed mode as described for optimum operation of the device under local atmospheric pressure conditions.

The low speed mode of the operating automotive gasoline internal combustion engine is selected to describe the operation of the integral components of the device employed in the operation of the engine. The accelerator controlled rod 44, in moving to the low speed mode to start the engine, moves the air intake control valves 14 and 15 slidably to a position similar to the position illustrated in FIG. 9, thereby further moving rods 56 and 54, rotating 3/4 discs 53 and partially closing pressure equalization valves 31, wherein the sliding outer edges of the air intake control valves simultaneously depress the compression pins 17 of microscitches $S_1$ and $S_2$ to complete the electronic circuit between inverter IC component 97 and the closed loop walking ring counter sub-circuit 75, 76 of FIG. 11, to activate the fuel pumps $P_3$ and $P_4$. These pumps will supply fuel for vaporization to chambers $V_3$ and $V_4$, as long as the accelerator pedal remains in a position in which switches $S_1$ and $S_2$ are closed. If the accelerator pedal is then released, for a shift to the idling mode, the valves 14 and 15 will revert to the position of FIG. 8, and switch $S_1$ will remain closed, but switch $S_2$ will become open and switch $S_3$ will be closed. This results in completion of the electronic circuit between inverter IC component 97 and the closed loop walking ring counter sub-circuit 77, 78 to drive alternately the pumps $P_1$ and $P_2$ and supply instead fuel alternately to atomizers 35 and volatilization chambers $V_1$ and $V_2$, resulting in a lesser volume of light gasoline vapor supplied to the engine. When the automobile is driven, the slidable valves 14 and 15 will be shifted to the low speed mode of FIG. 9. At times, while the automobile is picking up from a lower gear to a higher one, the acceleration pedal may be sufficiently depressed to move the valves into the high speed mode of operation of FIG. 10. During driving, the acceleration pedal may, at times, cause the valves 14 and 15 to vary between the low speed mode of FIG. 9 and the high speed mode of FIG. 10, in which event the larger volatilization chambers $V_3$ and $V_4$, along with pumps $P_3$ and $P_4$, will remain in operation continuously in an alternating step by step manner, while the pumps $P_1$ and $P_2$, together with the smaller volatilization chambers $V_1$ and $V_2$, cut in or out, depending upon whether the engine is operating at a low speed or high speed mode. It will be understood, of course, that as engine speed increases, the ignition pulses will increase and the number of pulses to the pumps $P_1$ through $P_4$, per unit of time, will also increase. Thus, the automobile will continue to increase in speed until the tractive effort required corresponds to the tractive effort produced by the engine, at the drive wheels, for the particular setting of the fuel control pedal.

From the foregoing, it will be evident that the objects and requirements of this invention have been fulfilled to a marked degree. Although a preferred embodiment is illustrated and described, it will be evident that other embodiments may exist and that various changes may be made, without departing from the spirit and scope of this invention.

What is claimed is:

1. A carburetor for an internal combustion engine comprising:

at least one air intake chamber;

a vacuum retention chamber;

passage means between each said air intake chamber and said vacuum retention chamber;

means for controlling the flow of air through said passage means to said vacuum retention chamber;

a fuel and air mixing chamber connected with said vacuum retention chamber and with the intake manifold of said engine; and means for supplying fuel to said fuel and air mixing chamber.

2. A carburetor as set forth in claim 1, including:

at least one volatilization chamber connecting with said fuel and air mixing chamber;

means for supplying fuel to each said volatilization chamber; and means for controlling said fuel supplying means so as to supply a lesser amount of fuel to said fuel and air mixing chamber at an idle mode of said engine, a slightly greater amount of fuel at a low speed mode of said engine and a greater amount of fuel at a high speed mode.

3. A carburetor as set forth in claim 2, wherein:

said means for supplying fuel to said volatilization chambers includes a pump for each volatilization chamber.

4. A carburetor as set forth in claim 2, wherein:

said means for controlling the flow of air through said passage means comprises at least one movable air valve; and means for varying the amount of fuel supplied to said volatilization chambers responsive to the relative position of said movable air valve.

5. A carburetor as set forth in claim 4, including:

cam means movable in accordance with the openings of said valves for varying the amount of fuel supplied to said volatilization chambers.

6. A carburetor as set forth in claim 5, wherein:

said movable air valves are gate type valves having an edge configuration to act as said cam means.

7. A carburetor as set forth in claim 3, including:

means for actuating said pumps intermittently at intervals corresponding to the speed of said engine.

8. A carburetor for an internal combustion engine comprising:

at least one air intake chamber;

a single vacuum retention chamber;

passage means between each said air intake chamber and said vacuum retention chamber;

means for controlling the flow of air through said passage means to said vacuum retention chamber;

a single upright fuel and air mixing chamber connected with said vacuum retention chamber and with the intake manifold of said engine, said vacuum retention chamber being above said mixing chamber; and means for supplying fuel to said fuel and air mixing chamber.

9. A carburetor as set forth in claim 8, including:

at least one vacuum control passage extending from said vacuum chamber downwardly alongside said mixing chamber and in communication with the intake of said engine.

10. A carburetor as set forth in claim 9, including:

means for controlling flow through each said vacuum control passage.

11. A carburetor as set forth in claim 10, wherein:

each said controlling means comprises an adjustable, pivoted plate type valve.

12. A carburetor for an internal combustion engine, comprising:

a fuel and air mixing chamber connected to the intake manifold of said engine;

means for controlling the supply of air to said mixing chamber;

a plurality of support fuel volatilization chambers at different positions around or along said mixing chamber, each said fuel chamber having an outlet connecting with said mixing chamber; and means for spraying fuel into said fuel chambers.

13. A carburetor for an internal combustion engine, comprising:

a fuel and air mixing chamber connected to the intake manifold of said engine;

means for controlling the supply of air to said mixing chamber;

a plurality of separate fuel volatilization chambers at different positions around or along said mixing chamber, each said fuel chamber having an outlet connecting with said mixing chamber;

means for supplying fuel to said fuel volatilization chambers including a series of fuel pumps connected to the respective fuel chambers;

at least one of said chambers having a different size than another of said chambers; and means for controlling said pumps to cause a variation in the operating sequence of fuel pumps and chambers in accordance with the idle, low and high speed modes of said engine.

14. A carburetor as set forth in claim 12, including:

a spray nozzle in each said volatilization chamber; and a series of ribs extending from the top and rear walls of said chamber to intercept said sprays.

15. A carburetor as set forth in claim 12, including:

a splash plate extending in spaced relation to said outlet and adapted to intercept sprays of fuel moving toward said outlet.

16. A carburetor as set forth in claim 15, including:

a series of ribs extending inwardly from the rear of said splash plate.

17. A carburetor as set forth in claim 12, including:

a separate pump for supplying fuel to the respective chambers; and means for controlling said pumps to cause a variation in the amount of fuel in accordance with the idle, low and high speed modes of said engine.

18. A carburetor as set forth in claim 17, including:

valve means for controlling the intake of air to said air fuel mixing chamber; and cam means responsive to the position of said valves for controlling the variation in fuel supplied to said chambers.

19. A carburetor as set forth in claim 18, wherein:

said intake valve means comprises one or more gate type valves; and said cam means is formed at the lateral edges of said gate valve or valves.

20. A carburetor as set forth in claim 18, wherein:

said fuel volatilization chambers and fuel pumps are four in number;

said air intake valves are two in number;

said cam means is operated to open or close four switches, two of said switches being closed for the idle mode of said engine, another two of said switches being closed for the low mode of said engine, and three of said switches being closed for the high speed mode of said engine; and an electric circuit controls the operation of the pumps through a series of impulses corresponding to the production of ignition impulses and operating two of said pumps for the idle mode, another two of said pumps for the low speed mode and all four of said pumps for the high speed mode.

21. A carburetor as set forth in claim 17, wherein:

the size of said fuel chambers varies and the capacity of the corresponding pump varies in accordance with the size of the fuel chamber.

22. A carburetor as set forth in claim 13, including:

a fuel chamber from which said pumps are supplied fuel, said pumps being below said chambers; and drain means for said volatilization chambers for draining unvaporized fuel to said fuel chamber.

23. A carburetor as set forth in claim 12, including:

pump means for supplying fuel to said fuel vaporization chambers;

means for producing control signals responsive to said means for controlling the supply of air to said mixing chamber;

said pump means is electrically operated; and means for controlling the supply of fuel to said fuel chambers including electronic circuit means receiving impulses from the ignition impulses of said engine and said control signals, for producing electrical impulses for driving said pump means.

24. A carburetor as set forth in claim 23, wherein:

said means for controlling the supply of air to said mixing chamber includes at least one movable valve and said signal producing means includes at least two switches closed at different positions of said valve;

said electronic circuit includes a monostable multivibrator of a duty cycle intergrator sub-circuit connected to the automotive ignition coil for transmitting constant width pulses across said electrical switches to a toggle walking ring counter sub-circuit, in a rotating step by step sequence for each toggle pulse; and said walking ring counter sub-circuits operating in a step by step sequence to transmit complement of said monstable electrical toggle pulses to connecting buffer integrated circuit sub-circuits and discrete power transistor circuit components connected to said electric fuel pumps.

* * * * *